US006198451B1

(12) United States Patent
Aylward et al.

(10) Patent No.: US 6,198,451 B1
(45) Date of Patent: Mar. 6, 2001

(54) RADAR ANTENNA FEED ARRANGEMENT

(75) Inventors: Michael James Aylward, Hertfordshire; Charles Anthony Rowatt, Middlesex, both of (GB)

(73) Assignee: Marconi Electronic Systems Limited (GB)

( * ) Notice: Subject to any disclaimer, the term of this patent is extended or adjusted under 35 U.S.C. 154(b) by 0 days.

(21) Appl. No.: 08/086,644

(22) Filed: Feb. 4, 1993

Related U.S. Application Data

(63) Continuation of application No. 07/540,818, filed on May 29, 1990, now abandoned.

(30) Foreign Application Priority Data

Jun. 7, 1989 (GB) ..... 8913041

(51) Int. Cl.[7] ..... H01Q 19/00; H01Q 21/06

(52) U.S. Cl. ..... 343/756; 343/700 MS; 342/361

(58) Field of Search ..... 343/756, 909, 343/700 MS; 342/361, 362, 365, 366

(56) References Cited

U.S. PATENT DOCUMENTS 2,788,440 * 4/1957 Ramsay et al. .
2,814,724 * 11/1957 Culshaw .
5,034,750 * 7/1991 Cardiasmenos ..... 342/361

FOREIGN PATENT DOCUMENTS 2067843 7/1981 (GB) ..... 343/909

* cited by examiner

*Primary Examiner*—Gregory C. Issing
(74) *Attorney, Agent, or Firm*—Kirschstein, et al.

(57) ABSTRACT

An antenna feed for a 94 GHz radar combining quasi-optic and microwave integrated circuit (MIC) techniques. The optical components (15–23) couple MIC receive and transmit boards (FIGS. 2, 3 and 4) to the antenna, which may be a steerable cassegrain. Co-polar and cross-polar received signals are coupled out of the optical system by transmitting/reflecting grids (3 and 5) and the transmit signal may be similarly coupled into it (7). The MIC's have antenna patch arrays which are oriented to suit the respective polarization plane and associated grid. The use of a Faraday rotator (17) in conjunction with a grid (5) in the optic path permits spearation of the transmit path (13) from the receive path (25), each then having it own MIC (FIG. 4 and FIG. 3). Alternatively, duplexing is performed in a common MIC (FIG. 6).

10 Claims, 6 Drawing Sheets

RADAR ANTENNA FEED ARRANGEMENT

This application is a continuation of Ser. No. 07/540,818, filed May 29, 1990, now abandoned.

BACKGROUND OF THE INVENTION

1. Field of the Invention

This invention relates to a radar antenna feed arrangement and is particularly suited to radar operation at high frequencies above, say, 70~80 GHz. At such frequencies it is difficult to achieve an antenna feed which is at the same time efficient and inexpensive.

2. Description of Related Art

Microwave integrated circuits (MIC's) have been proposed for use in antenna feeds but have tended to introduce limitations in both physical arrangement and efficiency. Quasi-optic (or Gaussian optic) techniques have also been proposed but without achieving the desired level of efficiency and ease of manufacture.

SUMMARY OF THE INVENTION

According to the present invention, a radar antenna feed arrangement comprises an optical axis extending towards an antenna interface, a microwave integrated circuit extending parallel to the optical axis, the microwave integrated circuit comprising an array of conductive antenna patches and associated stripline circuitry, quasi-optical focusing means coupling the antenna patches and the antenna interface, and duplexing means for coupling common transmit and receive signal paths at the antenna interface to separate transmit and receive signal paths at the microwave integrated circuit.

The arrangement preferably comprises a parallel-conductor grid adapted to transmit or reflect a radar signal according to the relative orientation of the polarization plane of the radar signal and the grid conductors, the grid being disposed on and obliquely to the optical axis to reflect suitably polarized signals between the microwave integrated circuit and the antenna interface and thus separate either differently polarized receive signals or transmit and receive signal paths. There may be included two parallel-conductor grids arranged to reflect co-polar and cross-polar received signals to respective arrays of antenna patches, the arrays being oriented in alignment with the respective co-polar and cross-polar signals. The conductors of the grids, as projected on to a plane to which the optical axis is perpendicular, may be mutually displaced by 45°, and the arrangement further include means disposed between the two grids for rotating the polarization plane of an incident signal by 45°, the grid more remote from the antenna interface together with the means for rotation through 45° constituting the aforesaid duplexing means.

There may be included a third grid disposed on the optical axis remote from the antenna interface, the two grids providing separation of co-polar and cross-polar received signals and the third grid providing diversion of the transmit signal path to a transmitting antenna patch array, the three antenna patch arrays being co-planar and having orientations such that the cross-polar array is at 45° to each of the co-polar array and the transmitting array which are mutually 90° apart. Alternatively there may be a transmitting horn feed aligned with the optical axis and separated from the antenna interface by the two grids.

The antenna patch arrays are preferably mounted on a common substrate.

One of the patch arrays may constitute a transmitting and a receiving array and the duplexing means may be provided by the associated stripline circuitry.

In any arrangement as aforesaid, there may be included a quarter-wave plate interposed between the antenna interface and the nearest grid, the quarter-wave plate converting between linear polarization on the feed side of the quarter-wave plate and circular polarization on the antenna side.

BRIEF DESCRIPTION OF THE DRAWINGS

Two embodiments of antenna feed according to the invention will now be described, by way of example, with reference to the accompanying drawings, of which.

DETAILED DESCRIPTION OF THE PREFERRED EMBODIMENTS

Figure 7:
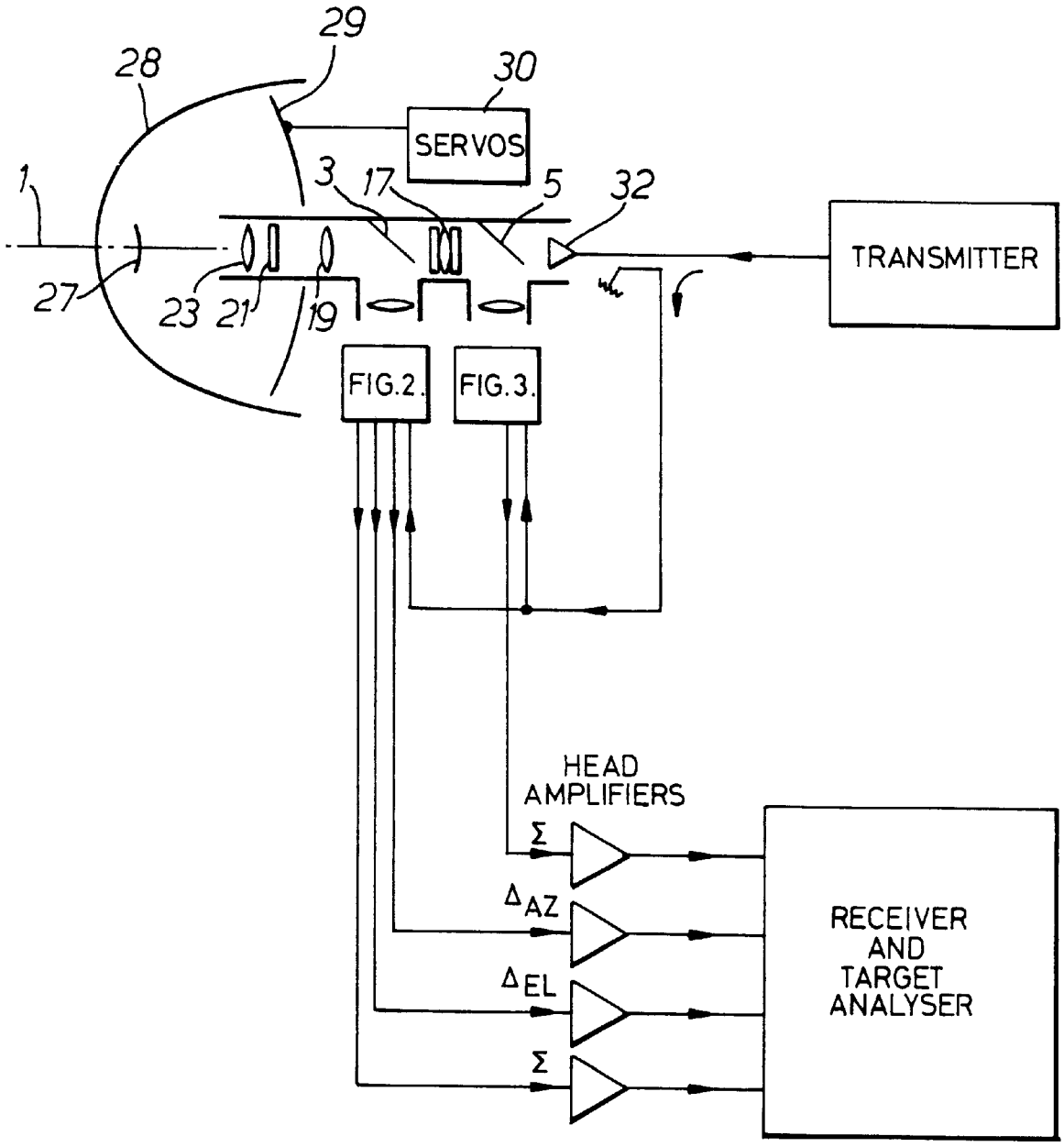
FIG. 7 shows the physical arrangement and connections of one MIC/quasi-optic feed arrangement in an antenna.

Referring now to the embodiment shown in FIGS. 1–4, an optical axis 1 is aligned with the radome axis (as shown in FIG. 7). Disposed along this axis are a succession of quasi-optical components which produce selective branching of an axial signal to microwave integrated circuits according to the plane of polarization. Three grids 3, 5 and 7, each comprising a plane array of fine conductors at spacings comparable to the operational wavelength, are arranged at 45° to the optical axis 1 so as to reflect a signal of suitable polarization plane at right angles to the optical axis. The grids are shown diagrammatically in side view in of FIG. 1 and in plan view in FIGS. 2–4. It will be seen that, in plan view, the grid wires are at 90°, +45° and −45° respectively in grids 3, 5 and 7, relative to the optical axis. The grids 5 and 7 will thus be seen to have wires at an angle arc tan $1/\sqrt{2}$ to their long edges so as to achieve the necessary 45° angle (of the wires) when tilted. It may also be seen that when projected on to a plane transverse to the axis 1, the wires are at 0°, +45° and −45° respectively to the horizontal.

Figures 1, 2, 3, 4:
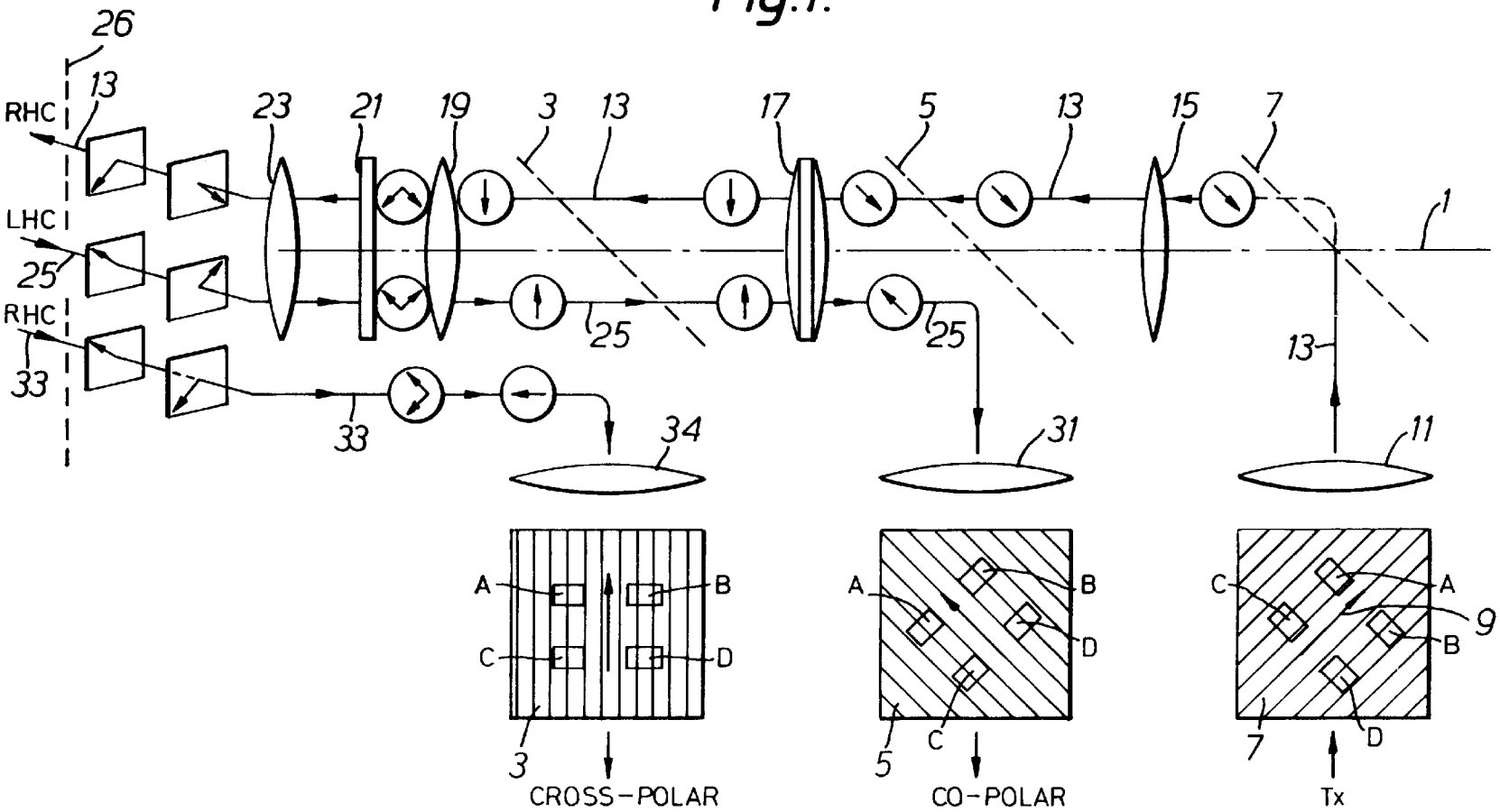
FIG. 1 is a diagram of the feed paths between radar circuits and antenna showing MIC antenna arrays coupled to optical paths selectively.
FIGS. 2, 3 and 4 are plan views of three grids depicted in FIG. 1.

Opposite the grid 7 is a transmitting MIC array of 4 conductive patches A, B, C and D shown in FIGS. 2–4 looking through the grid 7. This array and its stripline circuitry is shown in detail in FIG. 4A. When the transmitter array is properly energised four signal components in phase and having a polarization plane as shown by the arrow 9, are projected toward the grid 7.

The transmit signal comprising these four components in unison is focused by a dielectric lens 11 of fused silica on to the grid 7 along a path 13. The signal, having a polarization plane parallel to the grid wires, is reflected along the optical axis 1. (The path 13 is shown displaced from the optical axis 1 for clarity.)

The circles along the path 13 encompassing arrows show the direction of the E vector of the polarised signal looking in the direction of signal transmission and thus looking from right to left for path 13.

The transmit signal then passes through a dielectric lens 15 of high density polythene, with unchanged polarization, and is intercepted by a grid 5 similar to the grid 7 but having wires at 90° to those of grid 7 (in plan view—as shown below). Grid 5 is thus transparent to the transmit signal and the polarization plane is unchanged, as shown by the encircled arrows either side of the grid 5.

The next component along the axis is a Faraday rotator 17 of known type comprising a ferrite element subjected to a magnetic field. This component has the effect of rotating the polarization plane by 45°. The direction of rotation is in a single direction around the circumference of the component irrespective of the direction of signal transmission, i.e., rotation is clockwise for one direction of signal transmission and anticlockwise for the other. In the diagram, as indicated by the encircled arrows, rotation is clockwise from right to left (i.e., path 13) and anticlockwise from left to right (i.e., path 25 q.v.).

Grid 3 has wires horizontal and at 90° to the axis, and thus the now vertically polarised transmit signal sees it as transparent and passes through to a further dielectric lens 19 without any plane rotation.

At this point the vertically polarised signal may be considered as two orthogonal components, as shown encircled. A quarter wave plate 21 consists of a sapphire disc having differential dielectric constants on orthogonal diameters. The effect is to delay a component in the plane of the high dielectric constant by a quarter wavelength relative to a component in the orthogonal plane. The disc is arranged with these two diameters aligned with the two incident components shown. The result is that (after passing through a further dielectric lens 23) the two components are in space and time quadrature and thus exhibit circular polarization at this interface 26 with the reflectors of the antenna (shown in FIG. 7). The disposition of the plate 21 is such, in FIG. 1, that, as shown in the perspective view of the signal at this antenna interface, the polarization is right-hand circular.

As shown in FIG. 7, in which the same reference numerals apply, the circularly polarised signal is projected on to a fixed auxiliary reflector 27 and from there to the steerable main reflector 29 of a cassegrain antenna for illumination of a target.

If a target in the transmit beam should cause a single reflection (a so-called "odd bounce") the return signal will be of opposite hand i.e., in this case left-hand circular, as shown on path 25 at the antenna interface 26. The two components are brought into time alignment by the quarter-wave plate 21 and intercept the grid 3 with vertical polarization (as shown). Since both transmit and receive signals are linear at this point and in the same vertical plane, the received signal is termed the co-polar signal. The horizontal grid 3 appears transparent and the polarization plane is unchanged prior to the Faraday rotator 17. In this left to right transmission through the rotator an anti-clockwise rotation of 45° occurs as shown by the encircled arrow. As may be seen from the plan view of the grid 5, the signal is now in a plane parallel to the wires of the grid and is consequently reflected on to the receiver array ABCD of FIG. 3A by way of a dielectric lens 31.

If the transmitted signal suffers a double reflection (i.e., an 'even bounce') at a target it will be reflected with right-hand circular polarization, as on path 33. After transmission through lens 23 the received signal will be converted to linear polarization by plate 21 producing a resultant signal in a horizontal plane as shown encircled. By comparison with the vertical transmit signal at this point the horizontal signal is referred to as the 'cross-polar' signal. This signal is reflected from the horizontal grid 3 on to lens 34 and the antenna patch array of FIG. 2A.

It may be noted that in this arrangement duplexing of the transmitted and received signals is performed in the (quasi-) optical paths by the combination of controlled rotation and grid angles. For the above arrangement, the grids 5 and 7, or at least their plan projections, are required to be orthogonal and each to be at 45° from the grid 3.

Figure 2A:
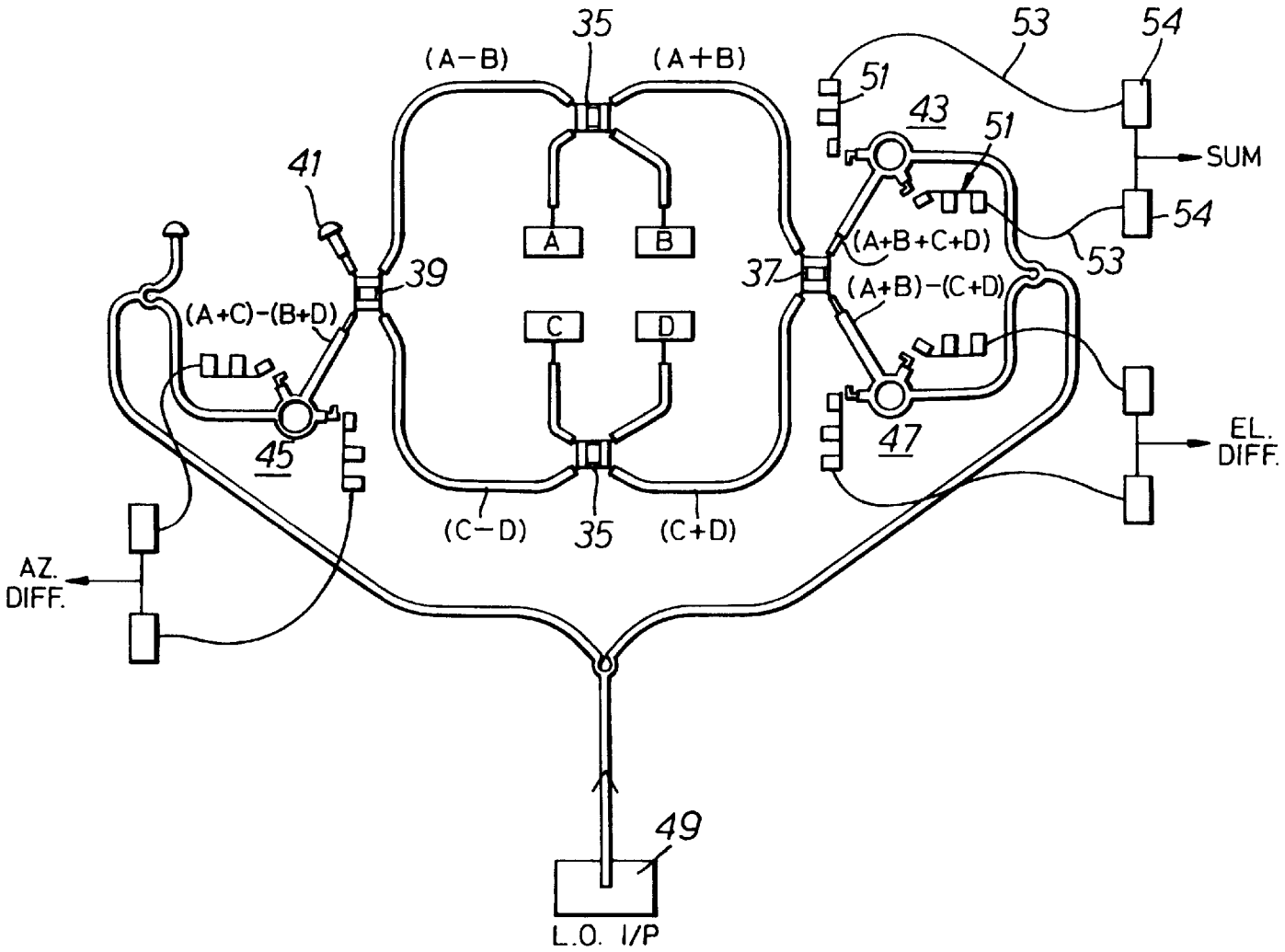
FIGS. 2A, 3A and 4A show MIC microstrip circuits for respectively, the cross-poler receiver, the co-polar receiver and the transmitter sections of FIG. 1.

Referring now to FIG. 2A, this shows a microwave integrated circuit based on four antenna patches ABCD being those shown in FIG. 1. These correspond to the conventional four antenna elements providing target location in azimuth and elevation in a phase comparison monopulse system. The four patches are irradiated by reflection from the grid 3 as explained above. Output signals from the patches are combined by hybrid couplers 35 which each produce two outputs, the sum and the difference of the two inputs. A further hybrid 37 produces the overall sum A+B+C+D and the elevation difference, (A+B)−(C+D), while a yet further hybrid 39 produces the azimuth difference (A+C)−(B+D) and a so-called nonsense channel signal which is applied to a resistive load 41.

The three outputs at the M-band radar frequency (suitably 94 GHz) are mixed with a local oscillator signal in respective mixers 43, 45 and 47. Since the receiver is a homodyne receiver, the local oscillator signal, input at patch 49, is derived (e.g., as shown in FIG. 7) directly from the transmitter, to give an output frequency band of 0–4 GHz or less.

Considering the mixer 43 as an example, this consists of a circular junction with two inputs, the sum signal and the local oscillator signal, and two diode coupling points at each of which a diode (provided as a discrete component—not shown for simplicity) bridges a gap to a filter network 51. Wired connections 53 are taken from the filter outputs to sum output patches 54. A single sum output is derived from a common link.

The elevation and azimuth difference signals are derived similarly.

Figure 3A:
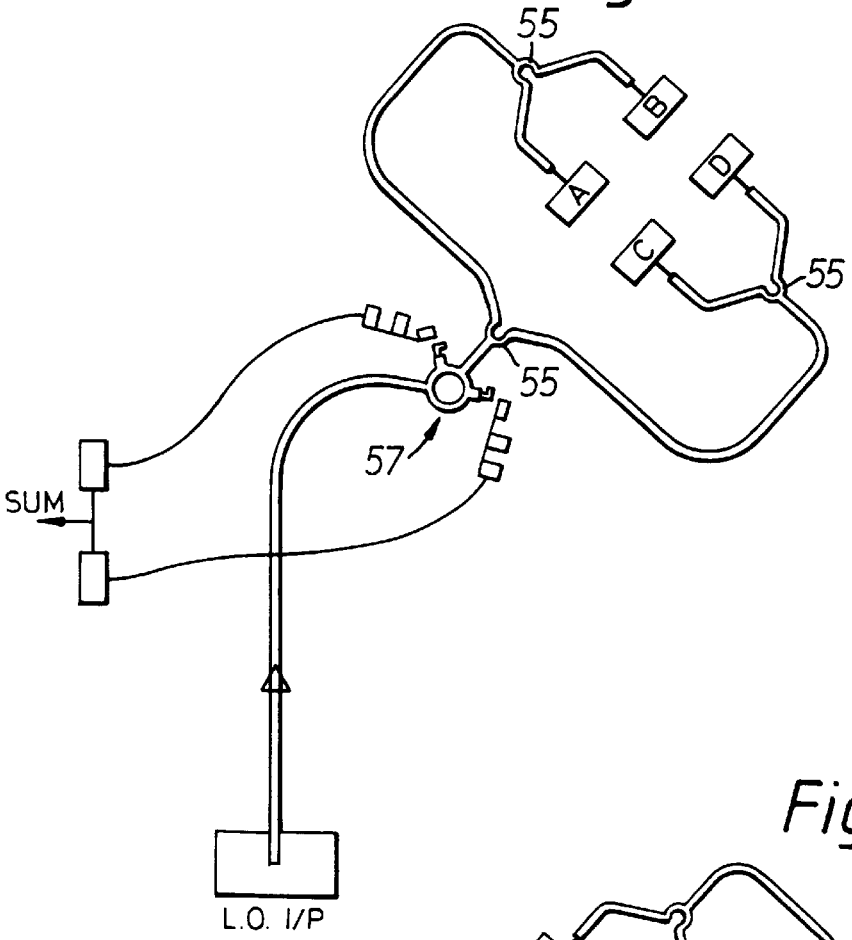

FIG. 3A shows a further receiving array of antenna patches oriented as in FIG. 1. This is a relatively simple MIC requiring only three summing junctions 55 and mixer 57. A single sum output is provided. A full monopulse output could equally be provided by use of hybrids instead of power splitters at the junctions.

Figure 4A:
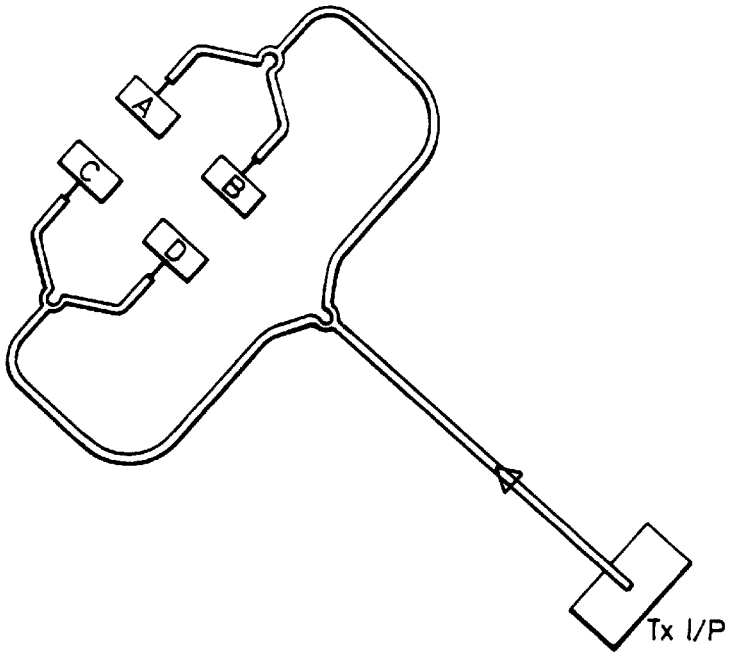

FIG. 4A shows the transmitter MIC, again of very simple form requiring only 'summing' junctions and no mixer.

Figure 5:
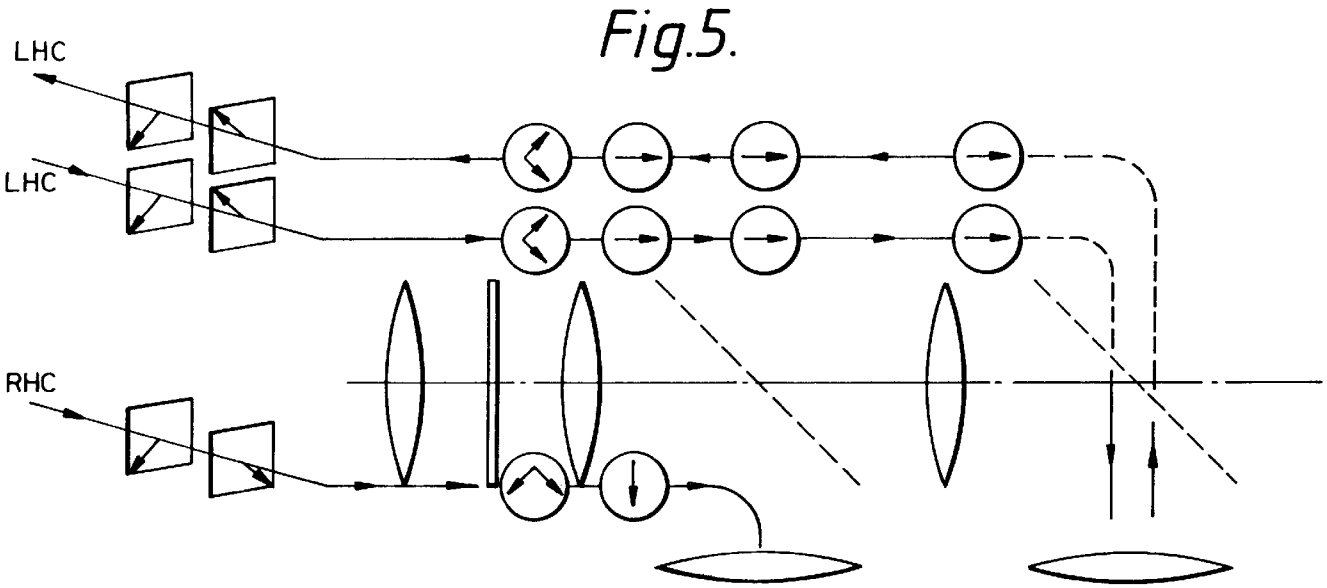
FIG. 5 is a diagram of a second embodiment similar to that of FIG. 1 but with the duplex switching incorporated in the microstrip as opposed to the optical components.

FIG. 5 shows an alternative embodiment employing only two grids and two corresponding MIC antenna patch arrays. The grids are simpler, both being of rectangular form albeit relatively orthogonal. No Faraday rotator is necessary in this design, as may be seen by following the progress of the encircled polarization planes. It may be noted that no separation of the transmit and (co-polar) receive paths occurs in the optical portions of the arrangement—duplexing is effected in the MIC's.

Figure 6:
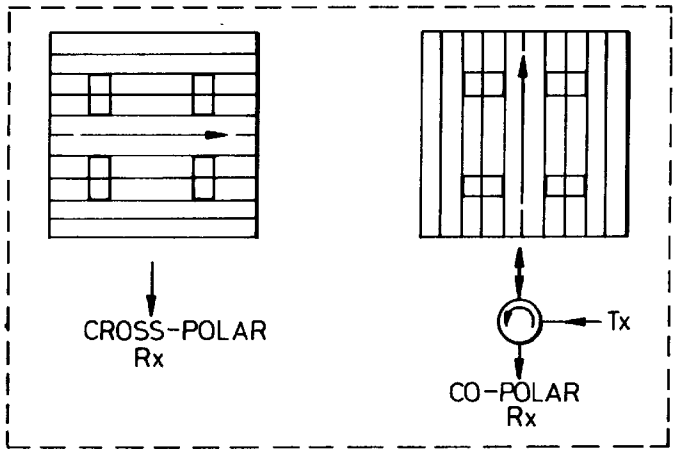
FIG. 6 is a plan view of two grids depicted in FIG. 5.
Figure 6A:
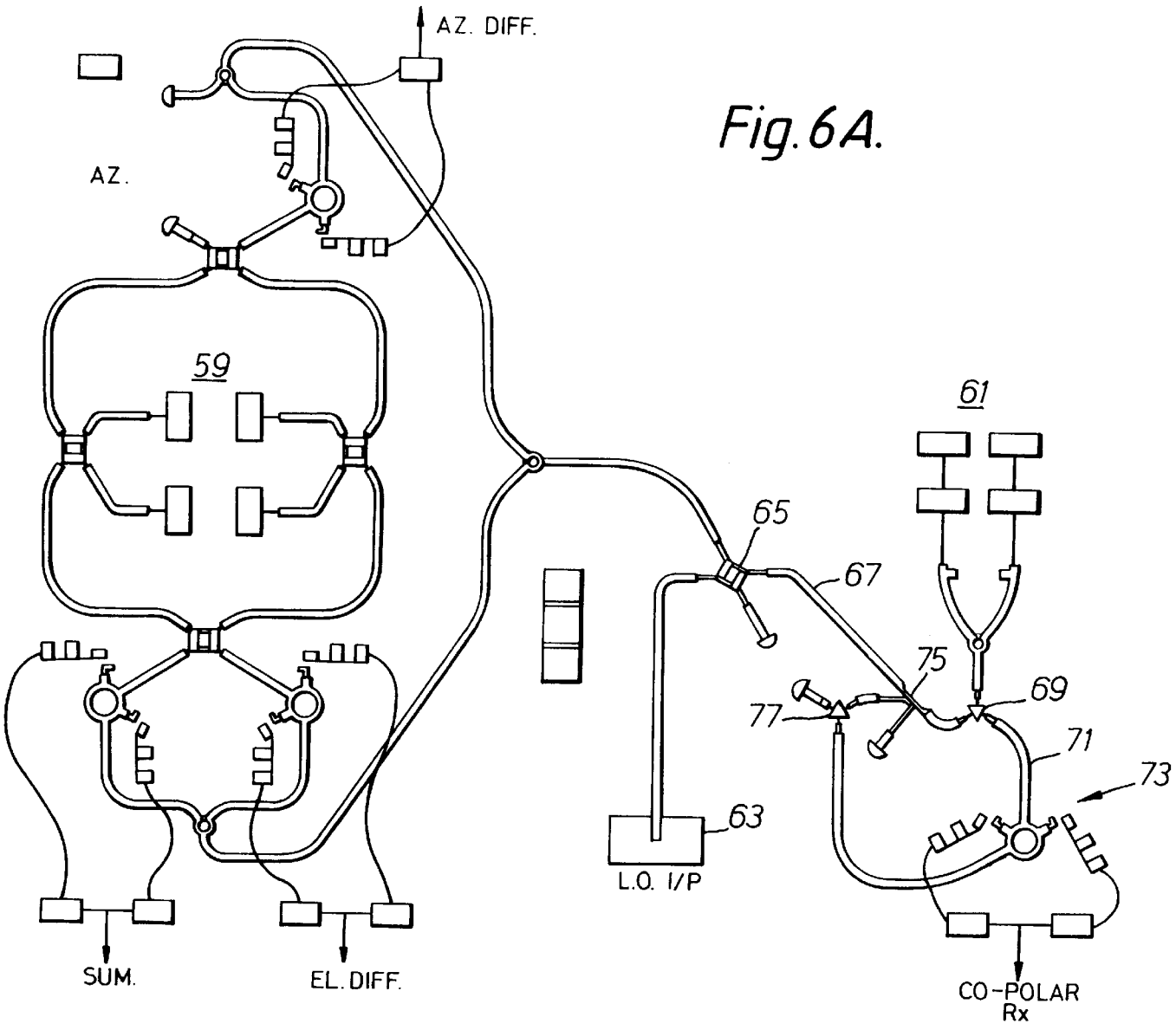
FIG. 6A shows the microstrip circuitry of FIG. 5 in detail.

Referring to FIG. 6A, both of the MIC's of FIG. 5 are shown, incorporated on a single board, an advantageous feature which may be adopted in preferred embodiments of the invention. The array 59 is connected as in FIG. 2A to give sum, azimuth and elevation differences, although with an initial 90° orientation of the antenna patches, as required by the grid in FIG. 6. A common local oscillator input 63 feeds both receivers 59 and 61. A hybrid coupler 65 splits the local oscillator feed to the two receivers, one path 67 being input to a circulator or duplexer 69. This element switches the L.O. signal to the array 61 for transmission and switches the signal received from the array to a path 71 to a mixer 73. The local oscillator input to the mixer is derived from the path 67 by way of a coupler 75 and circulator 77. The receiver output is then derived as a sum signal output from the mixer.

In this case duplexing is performed by the MIC, the L.O. signal being passed to the array 61 as the transmit signal and the co-polar receive signal being separated out by the circulator 69.

FIG. 7 shows the overall arrangement. A combined MIC/quasi-optic feed is directed at the auxiliary reflector 27 of a cassegrain antenna within a radome 28. The main reflector 29 is steerable by a servo system 30 to track a target.

The feed shown in this arrangement differs from that in FIG. 1 in that the transmit signal is provided by a horn 32 instead of the MIC of FIG. 4A and grid 7, but is otherwise similar. The various sum and difference outputs are then processed selectively for target recognition and confirmation purposes.

What is claimed is:

1. A radar antenna feed arrangement, comprising:

(a) an antenna interface for coupling a transmitted signal to and received signals from a radar antenna, (b) an optical axis extending towards said antenna interface, said transmitted signal and said received signals sharing common paths at said antenna interface, (c) a microwave integrated circuit extending parallel to said optical axis, (d) said microwave integrated circuit comprising (i) a substrate having opposite faces, (ii) a ground plane on one of the faces of said substrate, (iii) microwave components exclusively on the other of the faces of said substrate, (iv) said microwave components including first and second arrays of antenna patches active on said other face of said substrate exclusively, in respect of different polarizations, (v) each antenna patch comprising a continuous patch of conductive material adhering to said other face of said substrate, and (vi) said microwave components further including mixers connected to, but distinct from, said first and second arrays of antenna patches, (e) quasi-optical focusing means for coupling said antenna interface and said first and second arrays of antenna patches, (f) said quasi-optical focusing means including first and second parallel-conductor grids associated respectively with said first and second arrays of antenna patches, each grid being disposed on and obliquely to said optical axis so as to transmit along said optical axis or to reflect towards the associated array a received signal according to the relative orientation of the polarization plane of the received signal and the conductors of the grid, and (g) duplexing means for coupling said common paths at said antenna interface to separate transmit and receive signals paths at said microwave integrated circuit.

2. A feed arrangement according to claim 1, wherein said first parallel-conductor grid is oriented to reflect a received signal which is cross-polar with said transmitted signal, and said second parallel-conductor grid is oriented to reflect a received signal which is co-polar with said transmitted signal, said first and second arrays of antenna patches being oriented in alignment respectively with the conductors of said first grid and the conductors of said second grid.

3. A feed arrangement according to claim 2, wherein the conductors of said first and second grids, as projected on to a plane to which said optical axis is perpendicular, are mutually displaced by 45°, the arrangement further including a dielectric plate disposed between said first and second grids and perpendicular to said optical axis, said dielectric plate being adapted to rotate the plane of polarization of an incident signal through 45°, said plate and said second grid constituting said duplexing means.

4. A feed arrangement according to claim 3, wherein said microwave integrated circuit includes a third array of antenna patches for transmitting said transmitted signal and said quasi-optical focusing means includes a third parallel-conductor grid disposed on and obliquely to said optical axis and oriented to reflect said transmitted signal from said third array along said optical axis, the three patch arrays being co-planar and having orientations such that said first array is at 45° to each of said second array and said third array, and said second array and said third array are at 90° to one another.

5. A feed arrangement according to claim 3, including a transmitting horn for providing said transmitted signal, said horn having an axis aligned with said optical axis and being separated from said antenna interface by said first and second grids.

6. A feed arrangement according to claim 3, wherein said second patch array also constitutes a transmitting array for said transmitted signal, said microwave integrated circuit including stripline circuitry associated with said second array and constituting said duplexing means.

7. A feed arrangement according to claim 4, wherein said microwave components include said first, second and third patch arrays.

8. A feed arrangement according to claim 2, further including a quarter-wave dielectric plate interposed between said antenna interface and said first grid, said quarter-wave plate converting between linearly-polarized signals on the grid side of said quarter-wave plate and circularly-polarized signals on the antenna side of said quarter-wave plate.

9. A feed arrangement according to claim 1, wherein each patch has a rectangular shape.

10. A feed arrangement according to claim 4, wherein each patch has a rectangular shape.

* * * * *